United States Patent [19]

Phillips

[11] 4,115,940

[45] Sep. 26, 1978

[54] GARMENT HANGER WITH SIZE INDICATOR

[75] Inventor: Robert Phillips, Fort Lee, N.J.

[73] Assignee: A. & E. Warbern, Inc., Keasbey, N.J.

[21] Appl. No.: 820,267

[22] Filed: Jul. 29, 1977

[51] Int. Cl.[2] ..... G09F 3/00

[52] U.S. Cl. ..... 40/322; 223/85

[58] Field of Search ..... 223/85, 88, 92, 91, 223/93; 40/322, 1.5, 10 R, 16 R, 11 R; 24/255, 137 R

[56] References Cited

U.S. PATENT DOCUMENTS

| | | | |
|---|---|---|---|
| 1,321,926 | 11/1919 | Landry | 40/322 |
| 1,389,266 | 8/1921 | Newton | 40/322 |
| 2,166,492 | 7/1939 | Harvey | 40/322 X |
| 3,535,808 | 10/1970 | Morrish | 40/322 |
| 3,949,914 | 4/1976 | Ostroll | 223/85 |

*Primary Examiner*—George H. Krizmanich

*Attorney, Agent, or Firm*—Blum, Moscovitz, Friedman & Kaplan

[57] ABSTRACT

A garment hanger of the type having a garment carrying body, and a hook member which includes a member or portion contiguous the hanger body, the contiguous member serves to mount an indicia carrying tab. The hanger body, hook member and tab mounting member or portion may be molded in one piece. The indicia carrying tab is visible when a garment is hung on the hanger to disclose information about or relating to the garment to prospective purchasers, stock persons and others. The indicia carrying tab is removable and changeable, as desired.

9 Claims, 6 Drawing Figures

GARMENT HANGER WITH SIZE INDICATOR

BACKGROUND OF THE INVENTION

This invention relates generally to an improved garment hanger with indicia means which are removable so as to maximize the versatility of use of the garment hanger. While a variety of approaches have been taken to provide garment hangers with indicia means, such as that disclosed in U.S. Pat. No. 4,006,547, of which I am co-inventor, the present invention represents a novel and improved arrangement especially suitable for hangers of the type that are generally formed of plastic and have the body and hook integrally molded.

SUMMARY OF THE INVENTION

Generally speaking, in accordance with the invention, a plastic hanger is provided with removable indicia means for indicating the size, type or other information regarding the garment hung thereon. The hanger body and hook member are preferably integrally molded and preferably include an integrally molded member joining the hanger body and hook portion proximate the junction thereof. The member carries means for releasably attaching the indicia carrying means which are readily changeable yet are firmly attached to reduce accidental disengagement.

Accordingly, it is an object of this invention to provide an improved garment hanger having a member joining the hanger body and hook member for mounting indicia means visible to prospective garment purchasers, stock persons and others.

Another object of this invention is to provide an improved garment hanger having means for releasably mounting indicia means which provides easy interchangeability yet is secure against accidental disengagement.

A further object of this invention is to provide an improved garment hanger construction for carrying indicia means that is easily and economically molded in one piece.

Still another object of the invention is to provide an improved garment hanger with size indication capability which can be readily incorporated into the production of hangers of the known one-piece plastic type.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
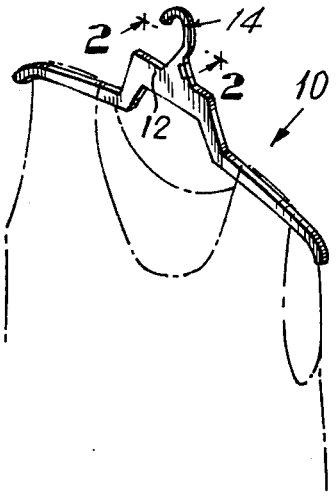
FIG. 1 is a perspective view of a garment hanger embodying the instant invention, with a garment hung thereon shown in phantom.

The drawings illustrate a garment hanger, generally indicated at 10 which is integrally molded and includes a hanger body 12 and a hook member 14. Hanger body 12 is generally planar and has a transverse reinforcing wall 16 running about its periphery. Similarly, hook member 14 is generally planar and has a transverse reinforcing wall 18 running about its periphery except where joined to body portion 12. Hook member 14 has a base section 20 extending at an acute angle to hanger body 12 and which includes a widened section 22 at the point where hook member 14 joins the shoulder 13 of hanger body 12. The aforesaid construction is commonly used for a wide variety of hangers currently on the market.

Figure 6:
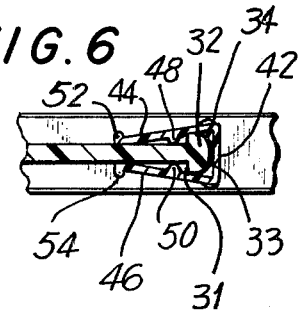
FIG. 6 is a partial sectional view taken along line 6—6 of FIG. 4.

An integrally molded tab mounting member 28 extends between the shoulder 13 of hanger body 12 and the base section 20 of hook member 14, and is generally triangular in overall configuration. Mounting member 28 fills in the junction between hook member 14 and body portion 12. Member 28 includes a generally thin, planar portion 30 which has a first transverse end wall 32. As best seen in FIG. 6, end wall 32 joins planar portion 30 along a pair of ledges 31 which extend inwardly from a curved outer surface 33 and define edges 34 and end wall 32. Located at the ends of end wall 32 are a pair of wider end walls 36, 38 which extend beyond edges 34 and are offset away from end wall 32 as shown in FIG. 2 to form a recess 39 for the alignment of an indicia carrying tab 40.

Indicia carrying tab 40 is formed from resilient material and includes an end wall 42 upon which is disposed the information 44 to be conveyed. Extending from end wall 44 are a pair of convergent side walls 44, 46 which include a pair of inwardly extending ribs 48, 50 mounted approximately at the midpoint of walls 44, 46 and a pair of outwardly extending ribs 52, 54 at their ends. Tab 40 is thus insertable in the recess 39 defined between end walls 36 and 38. Tab 40 is suited to be formed as a plastic extrusion.

Figure 2:
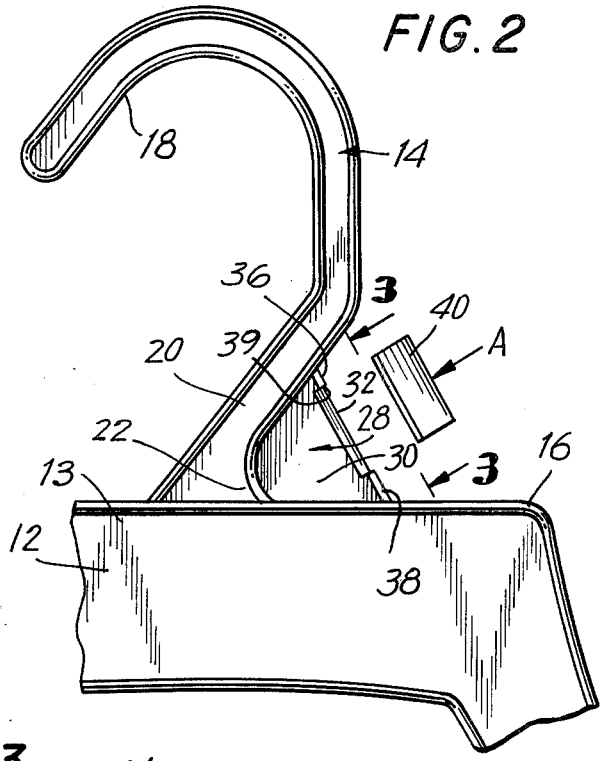
FIG. 2 is a partial side elevational view looking in the direction of the arrows 2—2 of FIG. 1, with the indicia carrying tab exploded away.
Figure 3:
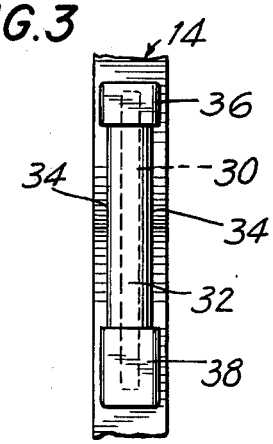
FIG. 3 is a partial elevational view looking in the direction of the arrows 3—3 of FIG. 2 with the indicia carrying tab removed.
Figure 4:
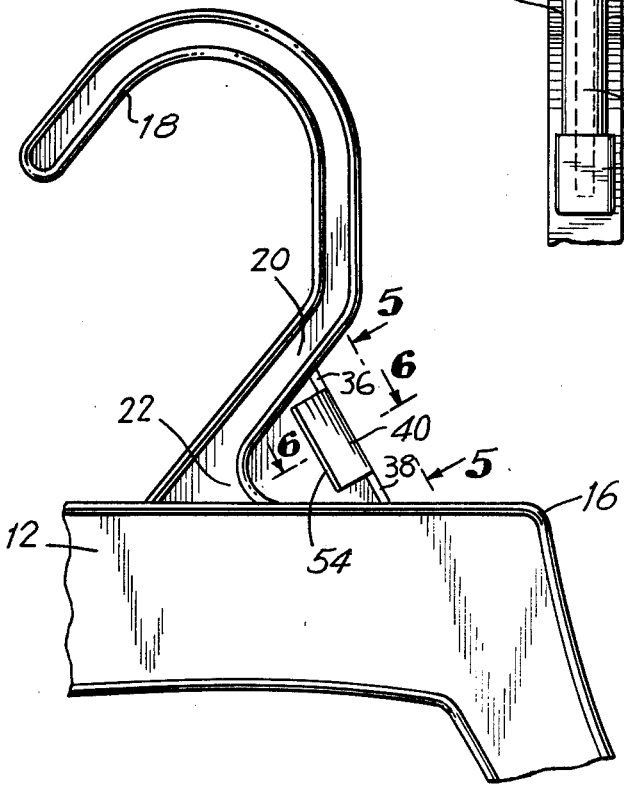
FIG. 4 is a partial side elevational view of the garment hanger with the indicia carrying tab in place.
Figure 5:
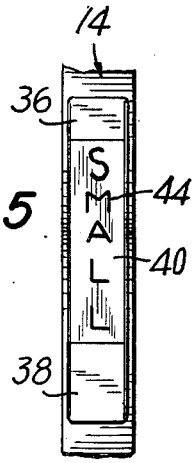
FIG. 5 is an elevational view looking in the direction of the arrows 5—5 of FIG. 4.

Tab 40 is inserted onto member 28 in direction A as shown in FIG. 2. Since, as noted above, tab 40 is constructed from a resilient material, side walls 44 and 46 will be spread apart upon contact with end wall 32. The side walls will be spread apart as they cam over curved outer surface 33. The normal convergence of the side walls aids in retaining tab 40 on member 28. As tab 40 is pressed further inwardly, ribs 48, 50 will slide over outer surface 33 and as end wall 42 approaches end wall 32 the resiliency of tab 40 will cause ribs 48 and 50 to be engaged behind ledges 31 thus releasably locking tab 40 into place. Outwardly extending ribs 52, 54 provide a sufficient purchase for a finger in order to easily remove and interchange tab 40. Walls 36 and 38 prevent tab 40 from sliding along its longitudinal axis and since walls 36 and 38 are offset from wall 32, the outer surface of end wall 42 of tab 40 is flush with walls 38 and 36 which serves to prevent accidental disengagement of tab 40.

The instant invention provides a means for providing customer information which is visible even when a garment is hung on the hanger, and which is readily interchangeable so that the information can be readily correlated with the garment. The construction disclosed provides for a simple and inexpensive indicia mounting system especially suitable for integrally molded one-piece hangers such as dress hangers, shirt hangers, frame hangers, pants' hangers and the like.

The position of member 28 at the junction of the hook 14 and body 12 assures that the information will be visible when the hanger is hung in normal fashion on a bar and has a garment thereon. In one preferred form, end wall 32 is sloped as shown in FIG. 2. However, end wall 32 could be vertical or have any other slope.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A garment hanger comprising a body, a hook member formed integrally with said body and being joined to said body at one end of said hook member, a tab holder formed integrally with said body and said hook member and being connected to both said body and said hook member substantially at the junction of said body and hook member thereby forming an integral, one piece structure of said body, hook member and tab holder, said tab holder being oriented substantially in the direction of a plane formed by said body and said hook member, said tab holder extending for a finite distance along an edge of said body and along an edge of said hook member and being further defined by a free edge extending between the terminus of the extent of said tab holder along said edge of said body and the terminus of the extent of said tab holder along said edge of said hook member and an information tab removably connectable to said tab holder, said tab holder and information tab including cooperating retaining means for holding said information tab on said tab holder against inadvertent dislodgement.

2. A garment hanger as claimed in claim 1, wherein said information tab is generally U-shaped and wherein the legs of said U-shaped information tab operatively engage said tab holder to define said cooperating retaining means.

3. A garment hanger as claimed in claim 2, wherein said free edge is disposed remote from the junction of said hook member and said body, and further includes a ledge proximate said free edge, said ledge projecting beyond contiguous portions of said tab holder in a direction generally perpendicular to the plane of said tab holder.

4. A garment hanger as claimed in claim 3, wherein said generally U-shaped information tab has resiliently spreadable legs, said legs including gripping means which are normally separated by a distance which is less than the width of said ledge.

5. A garment hanger as claimed in claim 4, wherein said gripping means are defined by the ends of said legs.

6. A garment hanger as claimed in claim 4, wherein said gripping means comprise ribs located on said legs intermediate the length thereof.

7. A garment hanger as claimed in claim 3, and further including information tab locating means on said tab holder.

8. A garment hanger as claimed in claim 7, wherein said information tab locating means comprises a pair of second ledges located at the edge of said tab holder, said pair of second ledges being disposed on opposite sides of said ledge and projecting beyond contiguous portions of said tab holder in a direction generally perpendicular to the plane of said tab holder by an amount which is greater than the projection of said ledge.

9. A garment hanger as claimed in claim 8, wherein said ledge is closer to the intersection of said hook member and said body than said pair of second ledges to provide a recessed positioning of said ledge as compared with said pair of second ledges.

* * * * *